US012680257B1

(12) United States Patent
Wheeler et al.

(10) Patent No.: US 12,680,257 B1
(45) Date of Patent: Jul. 14, 2026

(54) WORKSITE ENCLOSURE AND METHOD

(71) Applicants: Chase Berkley Wheeler, Lead, SD (US); Juan Pablo Castillo, Wahkon, MN (US); Rand Gordon Richard Woelber, Spearfish, SD (US)

(72) Inventors: Chase Berkley Wheeler, Lead, SD (US); Juan Pablo Castillo, Wahkon, MN (US); Rand Gordon Richard Woelber, Spearfish, SD (US)

( * ) Notice: Subject to any disclaimer, the term of this patent is extended or adjusted under 35 U.S.C. 154(b) by 0 days.

(21) Appl. No.: 19/355,898

(22) Filed: Oct. 10, 2025

(51) Int. Cl.
*E02D 17/08* (2006.01)

(52) U.S. Cl.
CPC ..... *E02D 17/086* (2013.01)

(58) Field of Classification Search
CPC ..... E02D 17/086
See application file for complete search history.

(56) References Cited

U.S. PATENT DOCUMENTS 490,779 A * 1/1893 Zimmerman ..... E04H 9/14 52/82
1,107,871 A * 8/1914 Alkire ..... A01K 1/033 135/117
1,635,942 A * 7/1927 Knudsen ..... A01K 1/0218 119/499
2,777,294 A * 1/1957 Rosa ..... F16L 1/036 405/157
4,027,912 A * 6/1977 Pacca ..... B60P 3/38 296/160
4,310,267 A * 1/1982 Davis ..... E02D 17/08 405/283
4,366,998 A * 1/1983 Kaiser ..... B25H 1/12 312/286
4,458,963 A * 7/1984 Keddie ..... A47C 13/00 312/902
5,611,641 A * 3/1997 Christensen ..... G09F 7/18 404/6
5,778,462 A * 7/1998 Bjorklund ..... A47K 11/02 4/476
6,101,769 A * 8/2000 Hamill ..... A47C 31/002 5/14
8,702,347 B2 * 4/2014 Manimala ..... E02D 5/60 405/157
2004/0255769 A1 * 12/2004 Drackett ..... F41H 5/14 89/36.09

(Continued)

*Primary Examiner* — Janine M Kreck

(57) ABSTRACT

An enclosure includes a first surface with first and second apertures, a second surface punctured by a first aperture and spaced apart from the first surface along a work direction, and lateral surfaces spanning between the first and second surfaces to define an enclosed volume. One aperture may include a hinged flap or door. The enclosure includes a lifting affordance and may further include a perforated shelf within the enclosed volume, tubes mounted proximate to the lateral surface with lumina communicating outside the volume, and rectangular tubes piercing both the first and second surfaces for receiving forklift forks. The enclosure may also incorporate a roof membrane spanning between the first and second surfaces, with the lifting affordance attached to the roof, and the roof may also include strakes for increasing structural integrity. Simpler embodiments of the enclosure may be fabricated from scrapped pressure vessels or timbers such as railroad ties.

16 Claims, 8 Drawing Sheets

(56) References Cited

U.S. PATENT DOCUMENTS

| | | | | |
|---|---|---|---|---|
| 2005/0116104 | A1* | 6/2005 | Savin | E04H 1/125<br>244/118.5 |
| 2010/0061800 | A1* | 3/2010 | Riddell | E01F 15/088<br>404/6 |
| 2017/0063054 | A1* | 3/2017 | Chu | E04H 17/003 |
| 2021/0363716 | A1* | 11/2021 | Daniluk | F41H 5/24 |

* cited by examiner

A–A

B–B

WORKSITE ENCLOSURE AND METHOD

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The invention relates to protective enclosures used at construction sites. More specifically, the invention is an enclosure used in a trench during open cut trenching or cut and cover pipe laying to support backfill material in a manner which reduces the length of open trench required, and also to protect workers involved in joining one section of pipe to the next.

BACKGROUND

Worker safety is always a priority when working in trenches for installing, repairing, or upgrading utilities infrastructure. Published data for the span of years 1991-2001 ranked trench collapses as the seventh leading cause of possible twenty-nine causes of OSHA-inspected fatal construction events. An AI query currently estimates the current ranking of trench collapses to be among the top ten leading causes of fatalities in construction, often fluctuating between the 5th and 8th position, specifically within the category of excavation-related incidents. Thus, inventions that prevent accidents and protect workers from the elements, or from soil collapse are always of interest and in demand in the construction industry.

BRIEF DESCRIPTION

A primary objective of the invention is to provide an enclosure for trenchwork which may be used to support backfill material in a manner which reduces the length of open trench required.

Another objective of the invention is to reduce the required length of open trench in an open cut or cut and cover operation. A corollary objective of the invention is to provide an enclosure for trenchwork enabling an improved and more efficient method of work whereby a single excavator machine may cut spoil material at a cut end of a trench and transfer the material directly to a backfill area behind the enclosure.

A corollary objective of the invention is to provide an improved work method for a open cut or cut and cover operation which eliminates the need for storing spoil material exhumed from a cut end of a trench. Another corollary objective of the invention is to reduce or eliminate the need for purchased or leased material moving vehicles such as dump trucks or containers such as a skip.

Yet another corollary objective of the invention is to provide an improved work method for an open cut or cut and cover operation which reduces the size or "footprint" of a construction work area for an operation, especially for reducing the width of the work area lateral to the direction of the pipe being installed.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION OF CERTAIN EMBODIMENTS

Figure 1A:
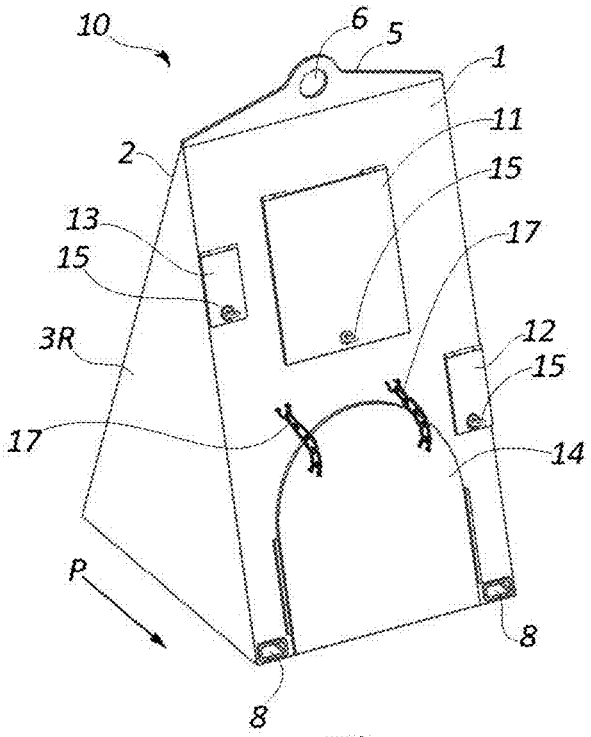
FIG. 1*a* shows an oblique, front top right view of an embodiment of a worksite enclosure in accordance with the invention.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise. The words "hingeably affixed" as used in this specification denote for a component that it may be hingedly affixed to another component or structure.

Open cut trenching, also known as trenched installation, is a traditional method where a trench is excavated to the required depth and alignment. Pipes or other utilities are then laid at the bottom of this open trench. After installation, the trench is backfilled with the excavated material. This method is widely used for utility installations and is characterized by its direct approach to excavation and backfilling. The environmental impact of open cut methods includes significant surface disruption, potential traffic congestion, noise, and dust. While it may be cost-effective in certain scenarios, especially for large-scale projects in open areas, the associated costs of surface restoration and traffic management may be substantial.

For open cut or cut and cover trench operations it is common that utility infrastructure such as pipes are furnished in sets wherein where many if not all elements of the set have the same length, and include means for extending the infrastructure by positioning and joining subsequent set elements onto previously installed elements. Pipes, underground cables, radial grounding wires for radio transmission antennae similarly define a work direction which the excavation will follow as the utility infrastructure is built and installed. In this specification, the word "forward" means a direction along the work direction, and "front" or "forward facing" refers to objects or surfaces (surface normal vectors) oriented substantially parallel to and along the work direction. The word "rearward" means a direction along the work direction, and "rear," "back," and "rearward facing" refer to objects or surfaces (surface normal vectors) oriented substantially parallel to but in a direction opposite to the work direction. The words "lateral" or "transverse" in this specification mean directions crosswise to or athwart the work direction. The word "by" may sometimes be used as a preposition meaning "proximate," "adjacent to," or "nearby."

Where grammatical genders are concerned, any user of the invention may be of any gender regardless of specific pronouns or grammar used in this specification. Thus, masculine grammatical forms may always be interpreted to include and subsume feminine or any other grammatical genders.

The invention includes a new apparatus for open cut trenching and a new method enabled by the apparatus. An exemplary embodiment of the new apparatus is an enclosure that includes a first surface with first and second apertures, a second surface spaced apart from the first surface along a work direction and punctured by a first aperture, and lateral surfaces spanning between the first and second surfaces, defining an enclosed volume. At least one aperture includes a hingeably affixed flap or door. The enclosure includes a lifting affordance and may further include a perforated shelf within the enclosed volume, tubes mounted proximate to the lateral surface with lumina communicating outside the volume, and rectangular tubes piercing both the first and second surfaces for receiving forklift forks. The enclosure may also incorporate a roof membrane spanning between the first and second surfaces, with the lifting affordance attached to the roof, and the roof may also include strakes for increasing structural integrity. Simpler embodiments of the enclosure may be fabricated from scrapped pressure vessels or timbers such as railroad ties, or any fabrication acting as an effective backfill accumulator for a new, improved method for a cut-and-cover method enabled by the disclosed apparatus.

Referring now to the figures, FIG. 1*a* shows an oblique, front top right view of an exemplary embodiment of a worksite enclosure [10] in accordance with the invention. The enclosure includes a first or forward facing surface [1] and a second or rearward facing surface [2,] and at least one lateral surface [3R] at least partially spaced apart from the first surface along a work direction [P.] The first surface is punctured by at least a first and second aperture, and in this example auxiliary third and fourth apertures as well. The apertures are covered by closable doors which may also optionally include handles [15] or latches. The forward facing, rearward facing, and lateral surfaces define an enclosed volume. The enclosure is designed to endure being picked up and moved periodically as construction proceeds along the work direction. A lifting affordance [6] is made available at the upper junction of the first and second surfaces, which in this example is a reinforcing spline, roof rib, or strake [5] pierced by a lifting eye and located proximate the juncture of the first and second surfaces.

By the lower aspects of the enclosure, forklift fork tubes [8] pierce and pass through the first and second surfaces. In preferable embodiments these are rectangular tubes which comport with the tapered rectangular lifting tines of a forklift. The forklift fork tubes are another kind of lifting affordance for safely and conveniently relocating the worksite enclosure.

The flaps or doors of the enclosure serve to exclude soils and foreign objects from entering the enclosed volume and storage locations within the worksite enclosure. The first aperture in the first surface is closable by a flap, a door, or a loosely attached occluder [14] which is an at least somewhat rigid membrane or plate connected to the first surface by a hinge or other flexible connections [17] such as lengths of chain or wire rope. A second aperture in the first surface is closable by a second flap or door [11.] In more elaborate embodiments in accordance with the invention, the worksite enclosure also includes storage tubes which pierce the first surface and are also closeable by doors or flaps. In the example shown, two such storage tubes are closed by flaps [12] and [13.] These storage tubes may store tools such as shovels, spades, pry bars, picks, and the like.

Figure 1B:
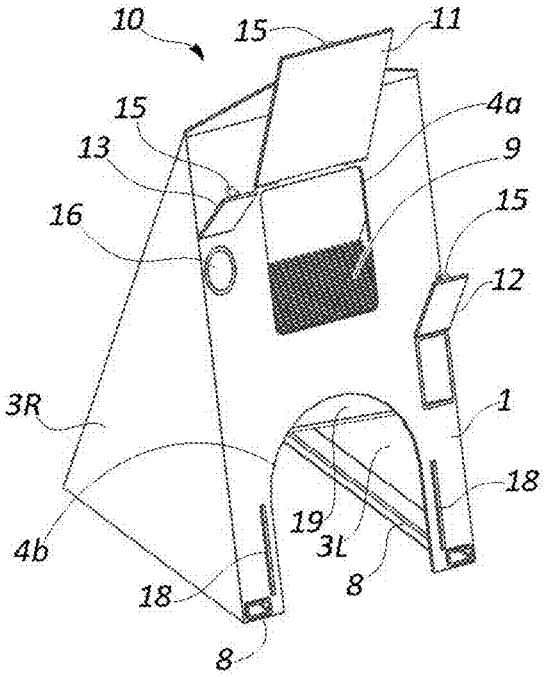
FIG. 1*b* shows the oblique, front top right view of the worksite enclosure of FIG. 1*a* with flaps [11,] [12,] and [13] raised open and with occluder [14 of FIG. 1*a*] omitted to reveal some internal structures.

FIG. 1*b* shows the oblique, front top right view of the worksite enclosure [10] of FIG. 1*a* with flaps [11,] [12,] and [13] raised open and with occluder [14 of FIG. 1*a*] omitted to reveal some internal structures. When closed, the occluder may be stabilized by strakes [18] which bestride the opening.

The first or forward facing surface [1] is perforated by a first or lower aperture [4*b*.] In preferable embodiments the contour of this first aperture interrupts the perimeter of the first surface, which is another way of defining that the aperture opens toward the ground and is not fully enclosed by material. Having this aperture open to the ground allows the enclosure to be placed atop an end of pipeline, then after another section of pipe is joined to the pipeline, the enclosure may be lifted clear and repositioned to the end of the section just added. If the aperture were not open to the ground, then disadvantageously the enclosure would have to be dragged along the length of the newly added pipe section and could not be used at all for a final assembly of the last length of pipe being connected to some other permanent underground infrastructure.

The first surface of the enclosure also has a second or upper aperture [4*a*] and a flap [11] hingeably affixed near the perimeter of the aperture. Within the enclosure is visible a shelf [9] located between the first and second apertures of the first surface. The shelf is preferably perforated or may be made of expanded metal sheet, so that tool or work objects such as pipe couplings, connectors, or gaskets may be may be positioned upon the shelf for inspection, cleaning, or preparation, while incidental soils fall through the shelf. The enclosure defines an interior volume between its front [1] and rear [2] surfaces and the lateral surfaces [3R] and [3L] spanning between them.

In the embodiment depicted, auxiliary storage compartments also called accessory tubes are formed with tubes mounted proximate to the insides of one or both lateral surfaces, with the tubes piercing the first surface at an orifice where a lumen of the tube communicates outside the enclosed volume. A round tube or pipe forms one such storage compartment [16] which is useful for storing poles, stakes, long pry bars, and other rod-like objects. Another compartment or accessory tube [19] may be made from rectangular tubing or with structural beam having an open contour, such as a C-channel, being closed by abutting the contour to the inside of a lateral surface. The lumina of these tubes are closable by flaps hingeably affixed to the first surface proximate these orifices.

By the lower aspects of the enclosure, forklift fork tubes [8] pierce and pass through the first and second surfaces. In preferable embodiments these are rectangular tubes which comport with the tapered rectangular lifting tines of a forklift. The forklift fork tubes are another kind of lifting affordance for safely and conveniently relocating the worksite enclosure.

Figure 1C:
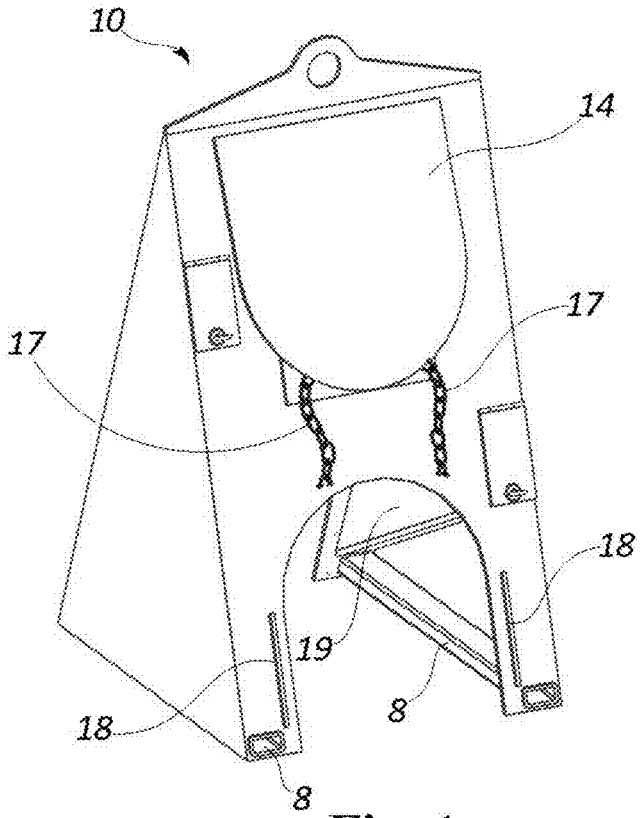
FIG. 1*c* shows another the oblique, front top right view of the worksite enclosure of FIG. 1*a* with flaps [11,] [12,] and [13] closed and flap [14] open.

FIG. 1*c* shows another the oblique, front top right view of the worksite enclosure [10] of FIG. 1*a* with flaps [11,] [12,] and [13] closed and flap [14,] which is also called an occluder, open. When closed, the occluder may be stabilized by strakes [18] which bestride the lower opening in the first surface. The occluder may be connected to the first surface by a hinge or other flexible connections [17] such as length of chain or wire rope.

By the lower aspects of the enclosure, forklift fork tubes [8] pierce and pass through the first and second surfaces. In preferable embodiments these are rectangular tubes which comport with the tapered rectangular lifting tines of a forklift. The first and second forklift fork tubes are preferably parallel to each other. Also seen in this figure is a portion of a rectangular tube [19] which is closed by a flap. This tube is useful for storing certain tools such as shovels, spades, rakes, and the like.

Figure 2A:
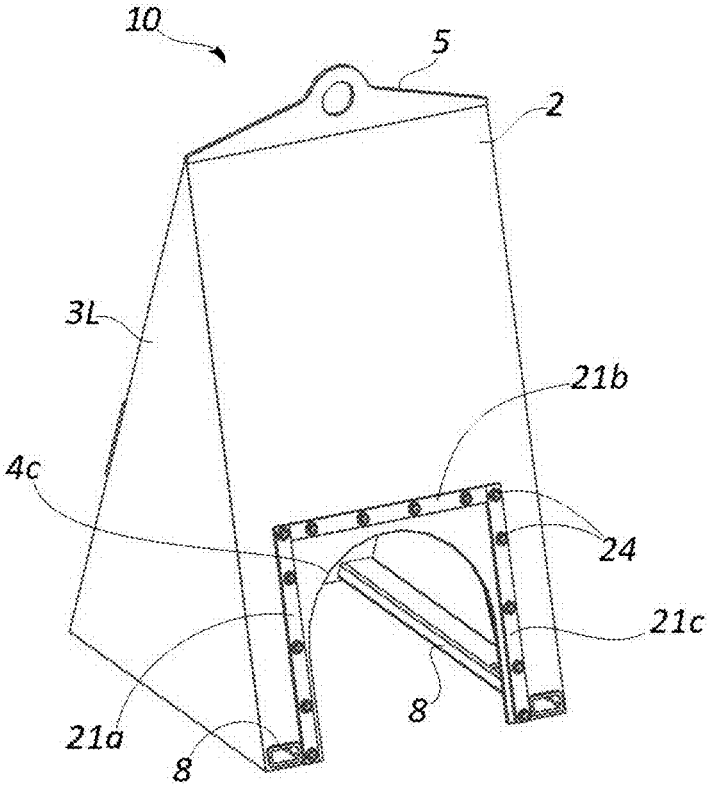
FIG. 2*a* shows an oblique, rear top left view of the worksite enclosure of FIG. 1*a*.

FIG. 2*a* shows an oblique, rear top left view of the worksite enclosure [10] of FIG. 1*a*. The rear surface [2] is the second surface of the enclosure, and like the first surface, it also includes a first aperture [4*c*] which also in preferable embodiments has a contour interrupting the perimeter of the second surface, which is another way of defining that the aperture opens toward the ground. The rear surface also attaches to another lateral surface [3L] spanning to close with the first or front surface.

A reinforcing spline, roof rib, or strake [5] is pierced by a lifting eye and located proximate the juncture of the first and second surfaces. By the lower aspects of the enclosure, forklift fork tubes [8] pierce and pass through the first and second surfaces. In preferable embodiments these are rectangular tubes which comport with the tapered rectangular lifting tines of a forklift.

In operation, the rearward facing surface accumulates backfill material piled against it, and as such it is subject to impacts and abrasion by rocks and spoils. Thus in preferable embodiments, apertures in the second surface, and especially the lower aperture, may be reinforced such as with reinforcing strips [21*a*,] [21*b*,] and [21*c*] mounted close to the perimeter of the aperture using sets of fasteners [24.] The reinforcing strips may be made of hardened alloy steel for abrasion resistance.

Figure 2B:
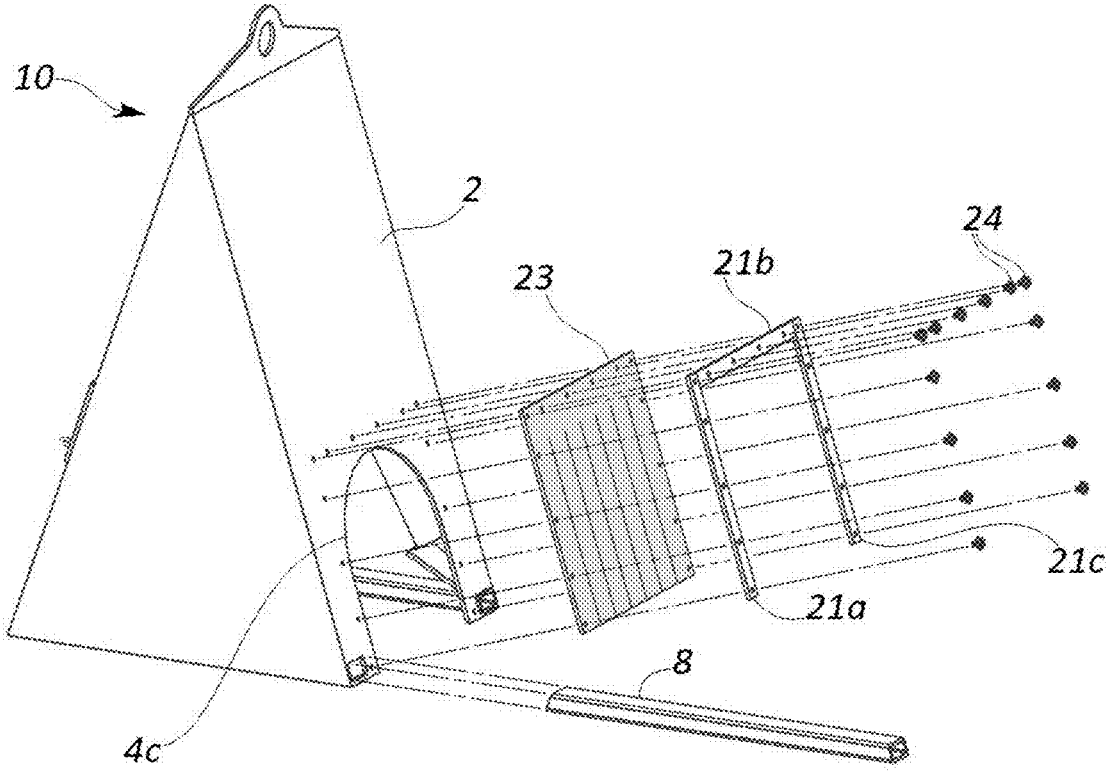
FIG. 2*b* shows another oblique, rear top left view of the worksite enclosure of FIG. 1*a* with some components exploded away from the rear, or second surface.

FIG. 2*b* shows another oblique, rear top left view of the worksite enclosure [10] of FIG. 1*a* with some components exploded away from the rear, or second surface [2.] One of the forklift fork tubes [8] is shown exploded from its installed position. The first aperture [4*c*] in the second surface may be optionally reinforced by reinforcing strips [21*a*,] [21*b*,] and [21*c*] mounted close to the perimeter of the aperture using sets of fasteners [24.] Also, rather than a rigid door or occluder, a flap, door, or membrane [23] made of durable, flexible material such as masticated rubber or fabric reinforced rubber sheet may be sandwiched between the rear surface and the reinforcing strips. The flexible membrane may also be slit to produce tasset sections depending from a balteus section, so that the tassets may drape around a pipe section as the enclosure is emplaced. The tassets reduce the amount of backfill entering the interior volume as backfill soil accumulates behind the enclosure.

Figure 3A:
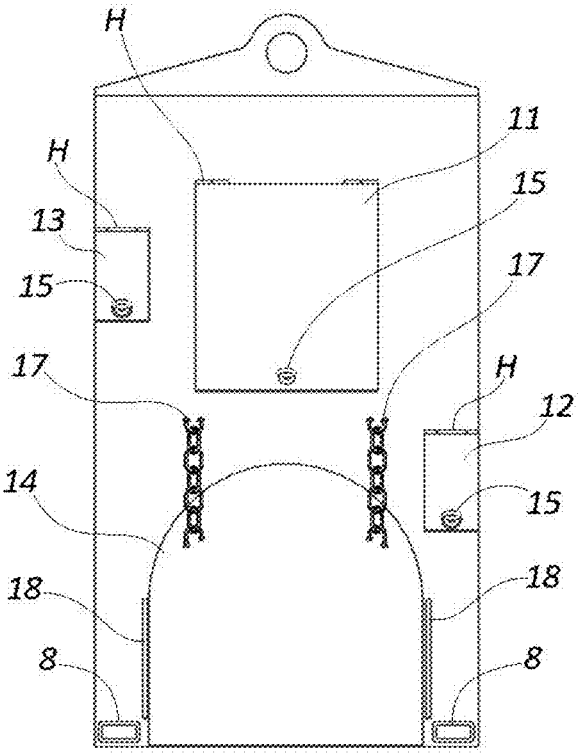
FIG. 3*a* shows a front view of the worksite enclosure of FIG. 1*a*.

FIG. 3*a* shows a front view of the worksite enclosure of FIG. 1*a*. In this example the flaps [11,] [12,] and [13] cover the second, third, and fourth apertures of the first surface respectively, and the occluder [14] closes the first aperture. In this embodiment the flaps are plates and are attached to the surface plate by pin and tube hinges [H.] The flaps include lifting rings [15] as handles. The occluder may be connected to the first surface by a hinge or other flexible connections [17] such as lengths of chain or wire rope. When closed, the occluder may be stabilized by strakes [18] which bestride the lower opening in the first surface. By the lower aspects of the enclosure, forklift fork tubes [8] pierce and pass through the first and second surfaces. In preferable embodiments these are rectangular tubes which comport with the tapered rectangular lifting tines of a forklift.

Figure 3B:
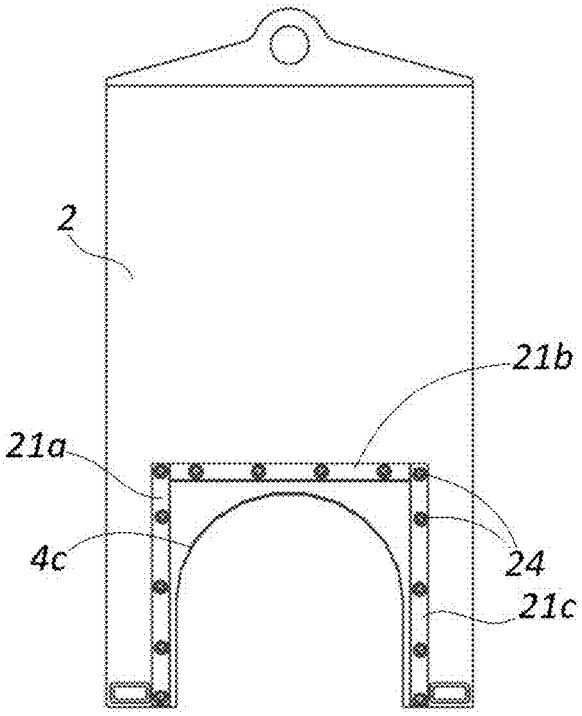
FIG. 3*b* shows a rear view of the worksite enclosure of FIG. 1*a*.

FIG. 3*b* shows a rear view of the worksite enclosure of FIG. 1*a*. The first aperture [4*c*] in the second surface [2] may be optionally reinforced by reinforcing strips [21*a*,] [21*b*,] and [21*c*] mounted close to the perimeter of the aperture using sets of fasteners [24.]

Figure 3C:
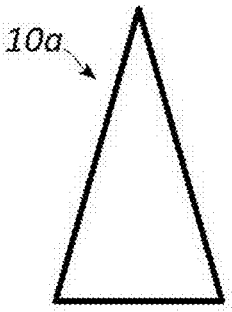
FIG. 3*c* shows a stylized side view of a worksite enclosure in accordance with the invention, having a perimeter substantially characterized as an isosceles triangle.

FIG. 3*c* shows a stylized side view of a worksite enclosure [10*a*] in accordance with the invention, having a perimeter substantially characterized as an isosceles triangle.

Figure 3D:
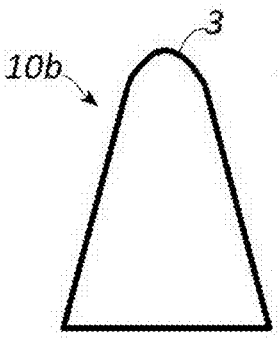
FIG. 3*d* shows a stylized side view of another exemplary worksite enclosure in accordance with the invention, wherein the first and second planar members are mutually inclined towards each other but do not meet at an apex.

FIG. 3*d* shows a stylized side view of another exemplary worksite enclosure [10*b*] in accordance with the invention, wherein the first and second planar members are mutually inclined towards each other but do not meet at an apex. Rather, a roof membrane spans between the first and second surfaces, and in preferable embodiments a lifting affordance would be affixed at the roof membrane.

Figure 3E:
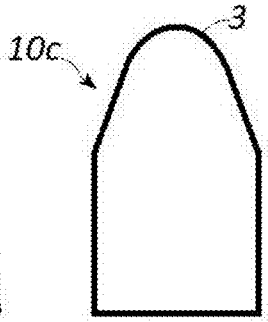
FIG. 3*e* shows a stylized side view of yet another exemplary worksite enclosure in accordance with the invention, wherein the first and second members are not entirely planar, have only portions which are mutually inclined towards each other, do not meet at an apex, but wherein this embodiment also includes a roof membrane.

FIG. 3*e* shows a stylized side view of yet another exemplary worksite enclosure [10*c*] in accordance with the invention, wherein the first and second members are not entirely planar, have only portions which are mutually inclined towards each other, do not meet at an apex, but wherein this embodiment also includes a roof membrane [3] spanning between the first and second surfaces, and in preferable embodiments a lifting affordance would be affixed at the roof membrane.

Figure 3F:
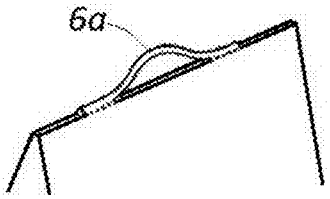
FIG. 3*f* shows an oblique view of an upper portion of an embodiment of a worksite enclosure in accordance with the invention, wherein the lifting affordance is a bar of material affixed to the top, apex, or upper aspect of the enclosure, and wherein the bar is formed to create an aperture for receiving lifting means such as a hook, a strap, or a loop of chain from a hoist or crane or other lifting means.

FIG. 3*f* shows an oblique view of an upper portion of an embodiment of a worksite enclosure in accordance with the invention, wherein the lifting affordance [6*a*] is a bar or rod of material affixed to the top, apex, or upper aspect of the enclosure, and wherein the bar or rod is formed to create an aperture for receiving lifting means such as a hook, a strap, or a loop of chain from a hoist or crane or other lifting means.

Figure 3G:
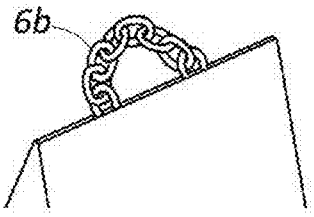
FIG. 3*g* shows an oblique view of an upper portion of an embodiment of a worksite enclosure in accordance with the invention, wherein the lifting affordance is a loop of lifting chain having its ends affixed to the top, apex, or upper aspect of the enclosure.

FIG. 3*g* shows an oblique view of an upper portion of an embodiment of a worksite enclosure in accordance with the invention, wherein the lifting affordance [6*b*] is a loop of lifting chain having its ends affixed to the top, apex, or upper aspect of the enclosure.

Figure 4:
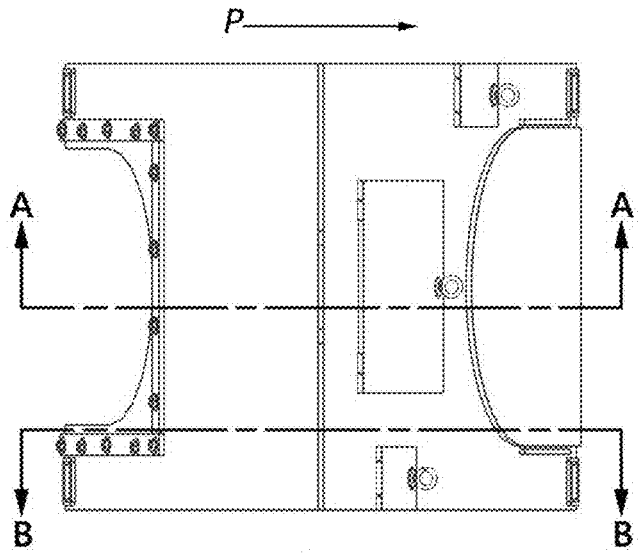
FIG. 4 shows a top view of the worksite enclosure of FIG. 1*a* and defines section line A-A for the cross section view of FIG. 5 and section line B-B for the cross section view of FIG. 6.
Figure 5:
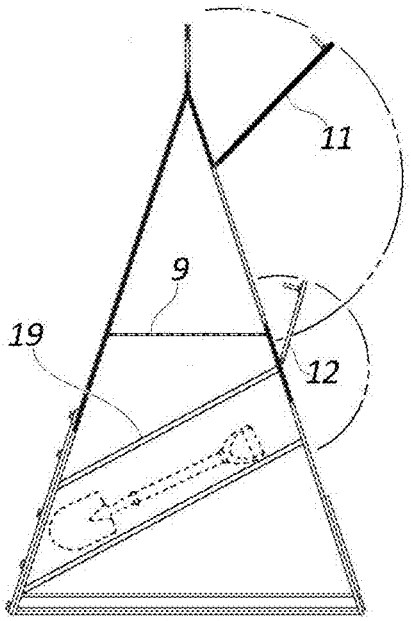
FIG. 5 shows a cross section view of the worksite enclosure of FIG. 1*a* taken at section line A-A as defined in FIG. 4.
Figure 6:
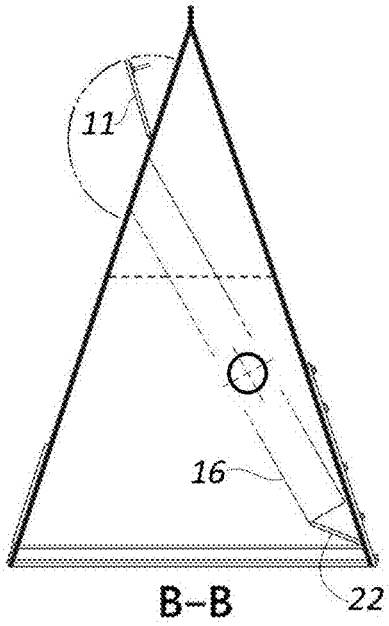
FIG. 6 shows a cross section view of the worksite enclosure of FIG. 1*a* taken at section line B-B as defined in FIG. 4.

FIG. 4 shows a top view of the worksite enclosure of FIG. 1*a* and defines section line A-A for the cross section view of FIG. 5 and section line B-B for the cross section view of FIG. 6. An arrow indicating the work direction [P] is included for reference.

FIG. 5 shows a cross section view of the worksite enclosure of FIG. 1*a* taken at section line A-A as defined in FIG. 4. The flap or door [11] for the second or upper aperture in the first surface is shown with its swing arc, and the second flap or door [12] also with its swing arc, for the first accessory storage tube [19] for tools such as the shovel shown in phantom line. The tube may be fabricated with a rectangular tube or a C-channel tube mounted proximate to the lateral surface and piercing the first surface at an orifice where a lumen of the tube communicates outside the enclosed volume of the enclosure. Also seen is the grille or perforated shelf [9] which may be accessed through the upper aperture of the first surface of the enclosure.

FIG. 6 shows a cross section view of the worksite enclosure of FIG. 1*a* taken at section line B-B as defined in FIG. 4. The enclosure of Claim 1, preferably includes one or more one tubes [16] mounted proximate to the lateral surface and piercing the first surface at an orifice where a lumen of the tube communicates outside the enclosed volume. This orifice is closable by flap [13] shown with its swing arc. In this view the tube is a round tube as seen in the rotated section depicted partway along its length. The bottom of the tube is open and an oblique floor plate [22] proximate the bottom of the tube is oriented skew from perpendicular to the axis of the tube. For rods, poles, and long pry bars and the like stored in this tube, these items often accumulate sticky mud or clay, and the oblique and disjoint floor plate allows caked-on matter to disengage from the implements and fall away to the soil beneath the enclosure.

Figure 7A:
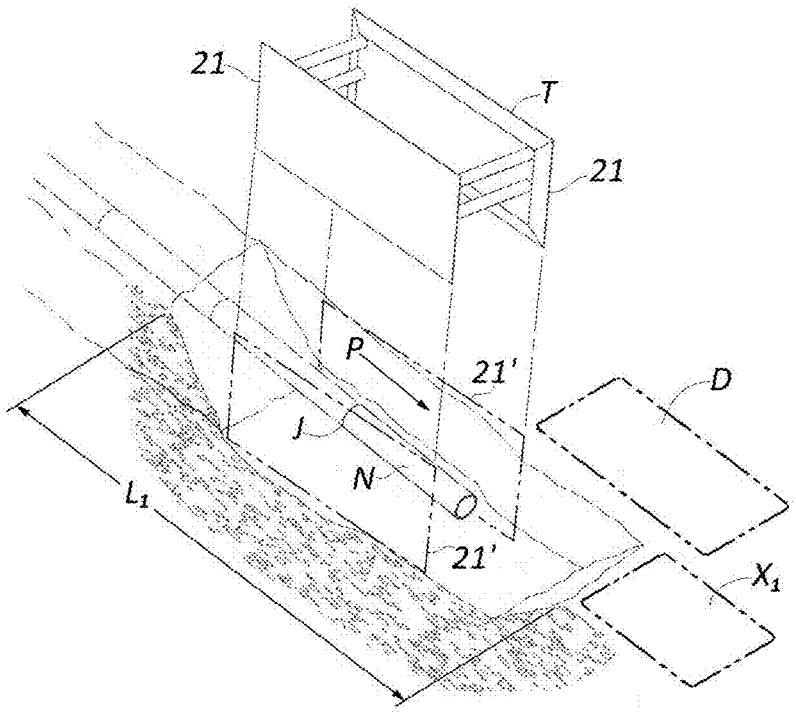
FIG. 7*a* shows an oblique, aerial view of a typical open cut or cut and cover pipe or conduit laying operation without the benefits of the invention.

FIG. 7*a* shows an oblique, aerial view of a typical open cut or cut and cover pipe or conduit laying operation without the benefits of the invention. A pipe laying operation includes sequentially attaching sections of pipe having a length [N] and excavating enough from a cut end of a trench in a work direction [P] for each successive pipe section to be aligned and attached to the pipeline at a joint [J.] For workers' safety a trench box [T] or shoring box is positioned in the trench to preserve workspace clearance lateral to the pipes being worked on and to prevent collapse of the trench by its sidewalls [31.] The trench box is shown exploded up and away from the works for clarity but in process it and its sidewalls [31'] would reside at the position shown in phantom line.

In typical practice, trench cutting proceeds at a distal end of the trench by an excavator [$X_1$] and then the soil removed by excavation must be temporarily stored somewhere until the joint at [J] is completed and may be covered. Where workspace is confined such as in a city environment, freshly excavated material is typically transported offsite by one or a succession of dump trucks [D] or by one or more roll-on/roll-off containers sometimes called skips.

The total length [$L_1$] of a trench in such a cut and cover operation is determined by the depth of cut, the length of the pipe sections being sequentially installed, and by the angle of repose of the soil at both ends of the trench. If the total volume of soil required to be removed exceeds the capacity of one truck or one skip, then the operation costs and complexity increase with the increasing numbers of vehicles and skips required to be involved.

Also, in typical practice if space permits, the spoil material is discharged to the left or right of the trench line, and in some cases regulations mandating certain minimum distances may apply, such as per OSHA requirements. Furthermore, coordination of trucks trans-porting material offsite and returning the material for the cover portion of the operation create opportunities for unwanted and costly delays and idle machines and workers while an excavator is waiting for a truck or a skip to show up. Where the dump truck or skip must be placed alongside and laterally offset from the work direction, the total "footprint" of the operation increases laterally and may require an additional lane of traffic to be closed. In some instances this additional hassle to commuter vehicle traffic and possible loss of revenues to local business caused by reduced access and foot traffic may be reflected as a permitting cost to the construction company. It would therefore be much preferable to confine the width of the construction zone as closely as possible, to dispense with haul-off and re-delivery of excavated material, and to eliminate if possible any necessity to discharge material lateral to the trenchline.

Besides dump trucks, other construction vehicles may be used in the vicinity of cut and cover pipe laying operations, and the worksite enclosure reduces the necessity of acquiring or leasing ancillary vehicles peripheral to the one or two excavators working the trenching operation using the new enclosure, the new method, or aspects of both. Such vehicles include offroad articulating haul trucks designed primarily to move on rough terrain not on public roads, and front end loaders such as those having 4 wheels which are available from many major brands of construction vehicle manufacturers. Other auxiliary vehicles include compact tracked vehicles sometimes called or "skid loaders," which are small, boxy loaders seen on many jobsites. A CTL (compact track loader) has tracks while a skid loader has wheels. A belly dump trailer is a vehicle usually used in asphalt mix and paving operations, but these may also be used to haul gravel, dirt, or spoil. Belly dump trailers are usually hauled by a semi-truck to a worksite and are not usually "street legal" for driving on municipal roadways unless locally permitted.

Side dump trailers are also often used in trenching operations and are also usually hauled by semi-truck. End dump trailers operate similar to dump trucks but they are separable from the tractor unit, and like regular dump trucks, the bed raises and material is discharged from the end, which usually has a flap or door. End dump trailers are easier to maneuver into place at excavation jobsites but do not haul as much material per trip as a side or belly dump.

Figure 7B:
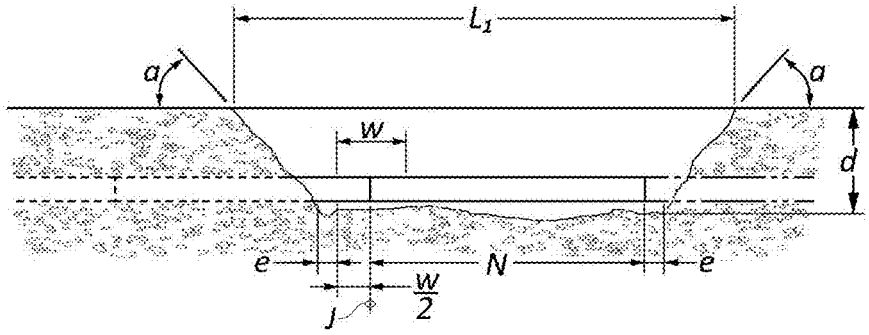
FIG. 7*b* shows a cut-away side view of the trenching operation depicted in FIG. 7*a*.

FIG. 7*b* shows a cut-away side view of the trenching operation depicted in FIG. 7*a*, to develop an understanding of the length of a trench required by a typical cut and cover operation. Beginning with the length of pipe sections [N,] at each joining operation a certain minimum width clearance [w] will be required. Assuming this job width to be symmetrically disposed over the joint site, then half of this width [w/2] would add to the minimum work length. The next pipe to be joined has a length [N] (including its bell end) and is to be joined at [J,] by welding, by bolts around mating flanges, sealants or sleeves for bell ends, couplers for corrugated pipe, or other means. The trench is cut long enough to receive the full length [N] of the next section of pipe. Additional minimum clearances [e] are required beyond the work area [w] and also beyond the opposite end of the pipe from the end to be joined.

The trench assumes a trapezoid shape because of the angle of repose [a] of the soil proceeding from the minimum floor length established by [N]+[w/2]+2[e], which is half the work area, one length of pipe, plus two clearances [e,] one at each end of the trench. For a given trench depth [d,] one may proceed upward at the angle of repose from each end of the trench until the surface is met, arriving at a total length of [$L_1$.] The excavator may backfill as close to the join area as half the work area length (w/2) plus the "extra" minimum clearance [e.]

Figure 7C:
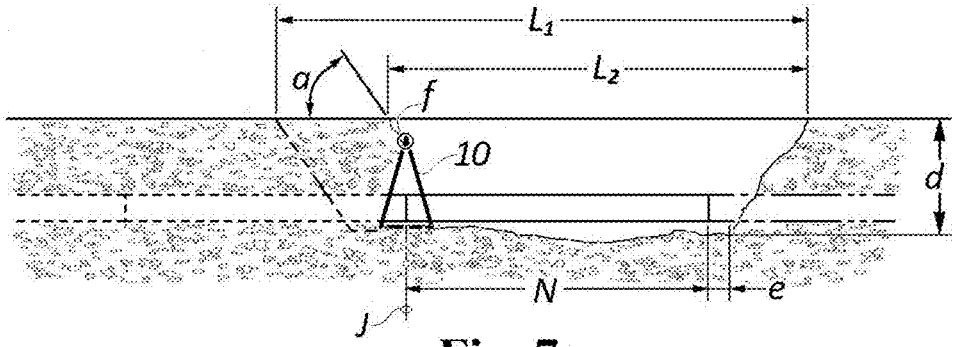
FIG. 7*c* shows a cut-away side view of an improved open cut or cut and cover pipe or conduit laying operation using a worksite enclosure in accordance with the invention such as that shown in FIG. 1*a*.

FIG. 7*c* shows a cut-away side view of an improved open cut or cut and cover pipe or conduit laying operation using a worksite enclosure [10] in accordance with the invention such as that shown in FIG. 1*a*, as part of illustrating an improved process enabled by embodiments in accordance with the inventive enclosure, which may also be referred to as a backfill accumulator for the process. The backfill accumulator facilitates a reduced trench length by raising the base of the angle of repose [a] of the backfilled material to a point [f] which is proximate the apex or roof membrane of the backfill accumulator. As seen in the previous figure, in the typical process the slope line of the backfill end of the trench meets the floor of the trench at a point roughly defined as half the work width [w] required for a joining operation at point [J,] plus an additional clearance [e.] Proceeding up the backfill slope line from the floor of the trench at depth [d,] one arrives at the crest of the backfill slope which is the left end of dimension [$L_1$] shown in this figure. The typical profile of this portion of the trench is shown in phantom line in this figure.

The other end of the trench has another inflection point where the trench floor meets the slope of the cut side of the trench. Although in some cases the angle of repose of recently cut soil may differ from the angle of repose of backfilled material because of many differences in soil behavior such as its plastic and liquid limits, moisture content, soil particle sizes and propensity for interlocking during stacking, and other geotechnical factors, in the depicted example the angles of repose at both ends of the trench are assumed to be similar. Thus, beyond another clearance [e] on the end of the pipe section opposite the joining end {J,] the slope of the cut end of the trench rises to the right end of dimensions [$L_1$] and [$L_2$.] It is seen that by using a backfill accumulator, the lower edge of the slope of backfilled material may be raised significantly above the floor of the trench and thereby shorten not only the length of the backfill slope but also its horizontal component, thereby shortening the overall length of the trench to [$L_2$,] shorter than [$L_1$.]

Figure 7D:
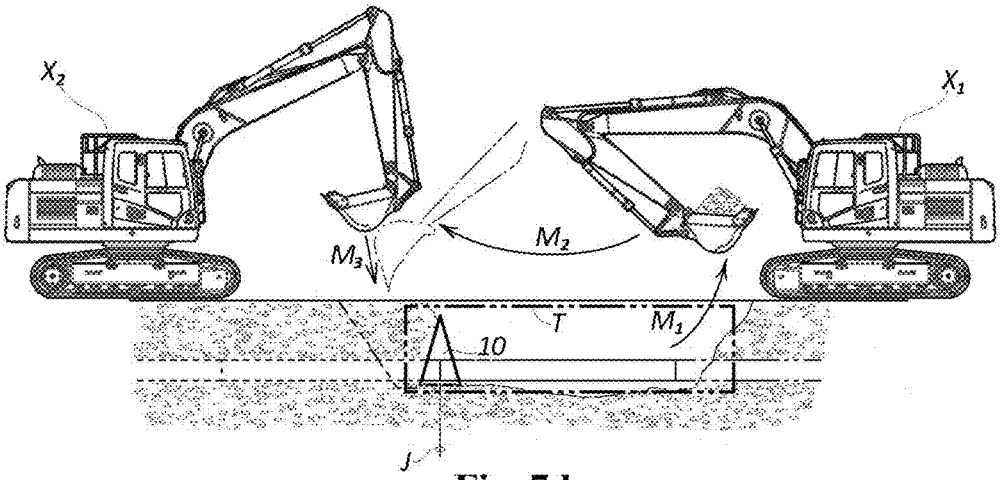
FIG. 7*d* shows the cut-away side view of the improved pipe or conduit laying operation seen in FIG. 7*c*, and also illustrates how a single excavator machine may cut spoil material at a cut end of a trench and transfer the material directly to a backfill area behind the enclosure.

FIG. 7*d* shows the cut-away side view of the improved pipe or conduit laying operation seen in FIG. 7*c*, and also illustrates how a single excavator machine may cut spoil material at a cut end of a trench and transfer the material directly to a backfill area behind the enclosure. The worksite enclosure [10] acts as a backfill accumulator in an operation where a section of pipe is being appended to a pipeline under construction at joint [J.] Because of the shorter length of trench enabled by the backfill accumulator as explained in FIG. 7*c*, it is possible for excavator machine [$X_1$] to cut at the cut end of the trench in motion [$M_1$] and immediately transfer and deposit spoil as backfill material behind the backfill accumulator in motion [$M_2$.] The trench shoring box

[T] is shown in phantom line. Optionally, a second excavator [$X_2$] may immediately compact the newly deposited backfill in motion [$M_3$.]

The need, operating costs, and sequencing logistics for other vehicles or skips for haul-off and redelivery are eliminated by the shortened trench and the improved process. Also, use of worksite enclosures in accordance with the invention reduce the need to swing or rotate the stick, boom, and cab subassembly of an excavator in a confined or limited space environment since the spoiled material may be deposited directly back into the trenchline.

Figure 7E:
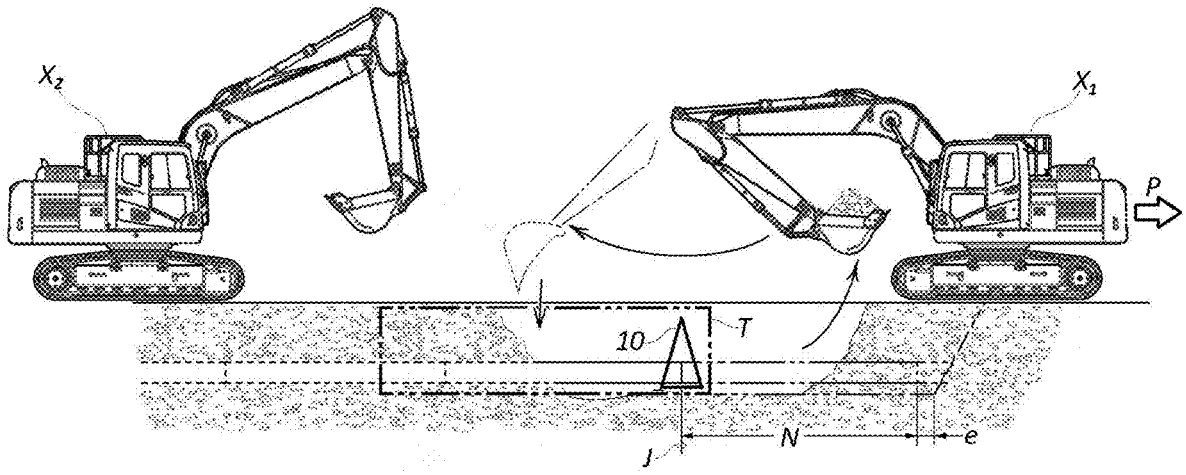
FIG. 7*e* shows the cut-away side view of the improved pipe or conduit laying operation seen in FIG. 7*c* at a later point in the process where Excavator [$X_1$] is traversing along the construction direction, has repositioned the worksite enclosure, and has almost finished removing enough soil for yet another section of pipe to be added and with the trench box also soon to be pulled in the construction direction.

FIG. 7*e* shows the cut-away side view of the improved conduit laying operation seen in FIG. 7*c* at a later point in the process where excavator [$X_1$] is traversing along the work direction [P,] has repositioned the backfill accumulator [10,] and has almost finished removing enough soil for yet another section of pipe to be added, and with the trench box [T] also soon to be pulled in the construction direction. The cutting will proceed until the trench is long enough for the next length [N] of pipe to be joined to the existing pipeline at [J,] with an additional work clearance length [e] for positioning the pipe section. As the cut soil is immediately transferred to the backfill end of the trench, a second excavator [$X_2$] may immediately compact the backfill material and move forward in tandem with the first excavator. This repeatable process for an open cut trenching operation, also called a cut and cover operation, which for this example is directed to sequentially laying additional sections of pipe to be joined to a previously installed section of pipe, may also be used for other kinds of connectable, extendable infrastructure such as underground electric transmission cabling, or fiberoptic communication lines.

The process steps include:

a. Providing a backfill accumulator configured to be positioned within a trench, the backfill accumulator comprising a rearward facing surface punctured by a first aperture and including a lifting affordance affixed to or integral to the backfill accumulator,
b. placing the backfill accumulator within the trench with its rearward facing surface oriented substantially perpendicular and opposite to a work direction defined by the sidewalls of the trench,
c. excavating soil from the trench along the work direction using a first excavator and cutting and removing spoil form an excavation face and depositing spoil directly behind the backfill accumulator in a single motion,
d. repeating step [c] until spoil accumulated behind the backfill accumulates to at least half the height of the backfill accumulator, and
e. repositioning the backfill accumulator from its location proximate the accumulated backfill and to a new location proximate the excavation face.

The process may also optionally include a step [b-1] following step [b] of utilizing the enclosure to keep backfill material away from at least a portion of the joint area during pipeline installation.

The process may also optionally include a step [b-2] following step [b] of installing a pipeline section within the trench such that the first aperture of the enclosure is positioned proximate to a joint area.

The process may also optionally include a step [d-1] following step [d] of compacting backfill material into the trench using a second excavator, wherein the backfill accumulator enables compaction up to at least half the height of the backfill accumulator, or preferably as close to the top of the backfill accumulator as may be practical.

Optionally, a second excavator [$X_2$] may immediately compact the newly deposited backfill. The need, operating costs, and sequencing logistics for other vehicles or skips for haul-off and re-delivery is eliminated by the shortened trench and the improved process.

Figure 8A:
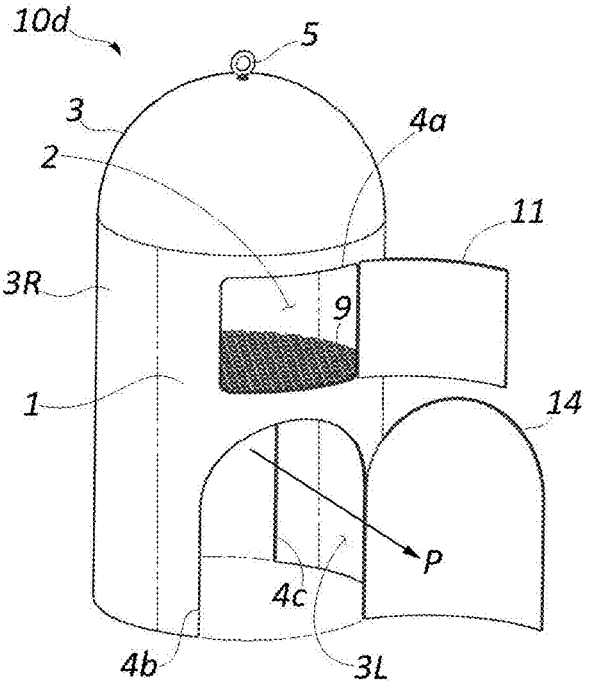
FIG. 8*a* shows an oblique, front top right view of another alternate embodiment of a worksite enclosure in accordance with the invention fabricated from a scrapped pressure vessel such as a propane or natural gas tank.

FIG. 8*a* shows an oblique, front top right view of another alternate embodiment of a worksite enclosure [10*d*] or backfill accumulator in accordance with the invention fabricated from a scrapped pressure vessel such as a propane or natural gas tank. In this type of embodiment, the enclosure includes a roof membrane [3] spanning between the first and second surfaces, and with lifting affordance [6] being affixed to the roof membrane.

In this type of embodiment the first surface [1] meets one or more lateral surfaces at a tangent shown in this figure by phantom lines, where for example the first surface meets lateral surface [3R,] and the second surface [2] meets lateral surface [3L] at a tangent.

The roof membrane may be formed in any of many effective shapes such as a rectangle, a square, a triangle, a portion of a sphere, a dome, a portion of a cylinder, a portion of an ovoid, a parabolic arched vault, and a barrel vault. The roof membrane, first and second surfaces, and the lateral surfaces define an enclosed volume. In the embodiment shown, the first surface includes a first aperture [4*b*] with the contour of this aperture interrupting the perimeter of the first surface, which is another way of defining that the aperture opens toward the ground. A second aperture [4*a*] in the first surface also communicates with the enclosed volume. A grille or perforated shelf [9] is mounted within the enclosed volume between the first and second apertures in the first surface.

Although the doors are shown hinged by the sides of the apertures in the first surface, as shown in other embodiments the doors may also be fashioned as flaps or occluders and may be attached by flexible connections such as lengths of chain or wire rope in addition to hinges. A first flap, door, or occluder [14] is closable against the first aperture in the first surface and a second flap or door [11] is closable against the second aperture in the first surface. The second or rearward facing surface also includes a first aperture [4*c*,] and a passage from the first aperture of the second surface to the first aperture of the first surface defines a work direction for alignment with the extendable infrastructure to be joined within the enclosed volume of the worksite enclosure.

Figure 8B:
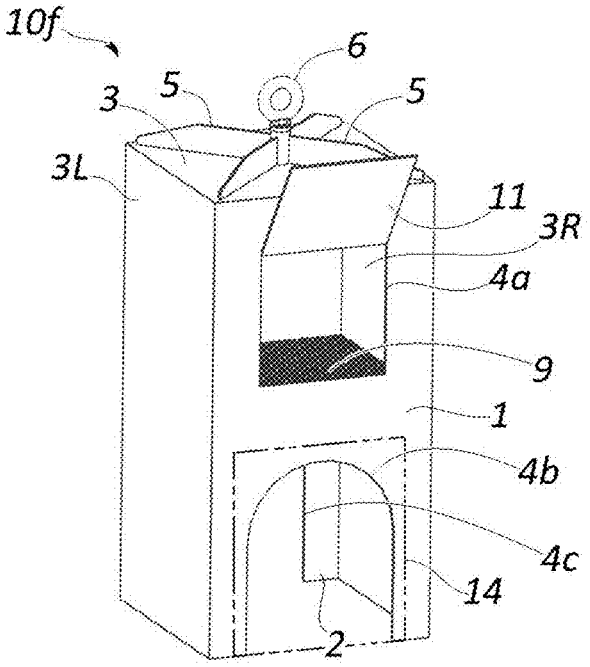
FIG. 8*b* shows an oblique, front top right view of yet another alternate embodiment of a worksite enclosure in accordance with the invention fabricated from sheet metal plates.

FIG. 8*b* shows an oblique, front top right view of yet another alternate embodiment of a worksite enclosure or backfill accumulator [10*e*] in accordance with the invention fabricated from sheet metal plates. The enclosure includes a first, forward facing surface [1,] a second, rearward facing surface [2] and at least one but in this version two lateral surfaces [3L] and [3R] which span between the first and second surface. A roof membrane [3] also spans between the first and second surfaces, with lifting affordance [6] being affixed thereto. The front, rear, and lateral surfaces and the roof define an enclosed volume.

The forces for lifting or moving the enclosure are collected at the lifting affordance by strakes or splines [5] affixed to and radiating from the lifting point along the top of the roof membrane. These reinforcing structures are preferably designed to withstand forces not only greater than the sum of the weight of the enclosure plus the weight of objects stored within it, but also to withstand additional forces accumulated by the enclosure possibly hanging up on obstructions in the trench or while breaking it free from adhesive mire or clay-like soils.

The first surface includes a first and second apertures [4*b*] and [4*a*] respectively, and a grille or perforated shelf [9] disposed within the enclosure between these two apertures. The second surface also includes a first aperture [4*c*.] The contours of the apertures in both the first and second surfaces interrupt the perimeter the first and second surfaces respectively, which is another way of defining that these apertures both open toward the ground, and together both are alignable along a work direction [P,] so that the enclosure may be delivered and lowered in place over a joint site or work site along a lenticular object such as a pipe or a long structural member such as a beam, or a fiberoptic connection.

A first flap, door, or occluder [14] is shown in phantom line and is closable against the first aperture in the first surface, and a second flap or door [11] is closable against the second aperture in the first surface. The doors or flaps may be affixed to the structure by hinges or by other flexible connections such as length of chain or wire rope.

The enclosure protects the area being worked on from incursion by soil, wind borne objects, and precipitation. Thus, joining operations that use flux, gaskets, grouts, marking ink, specialty adhesives and the like may proceed in the midst of excavation while soils in motion and other environmental debris are substantially excluded from the joining site. Since the enclosure also excludes ambient light, operations or tests which are better conducted in the absence of direct sunlight may be more easily performed while using the worksite enclosure. Examples include assessing heated steel temperatures and tempers by color, or Magnaflux® testing (magnetic particle inspection) for material integrity of a joint.

Figure 9A:
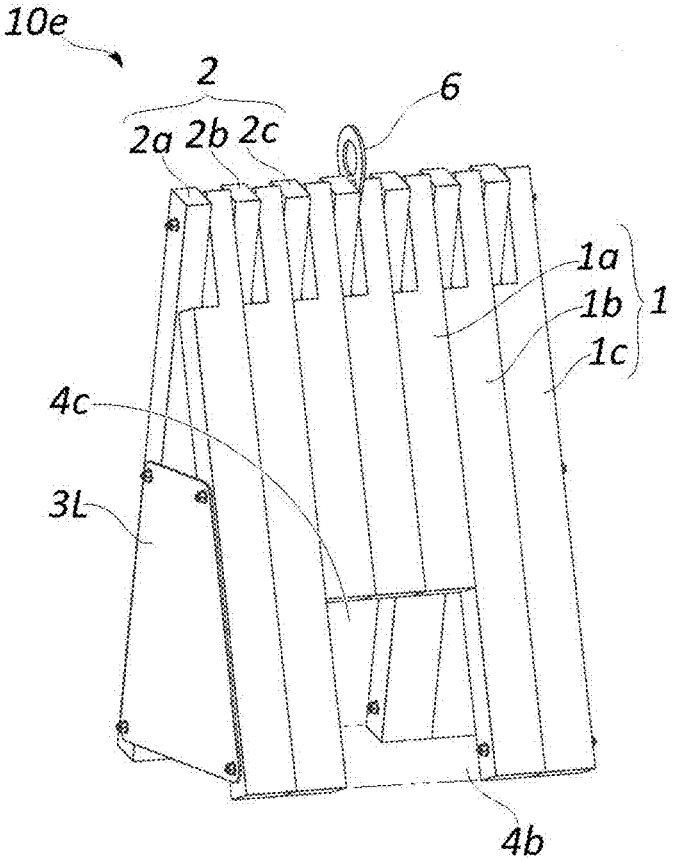
FIG. 9*a* shows an oblique, front top right view of another alternate embodiment of a worksite enclosure in accordance with the invention constructed primarily from railroad ties.

FIG. 9*a* shows an oblique, front top right view of another alternate embodiment of a worksite enclosure or backfill accumulator [10*f*] in accordance with the invention constructed primarily from railroad ties. In examples of this type of embodiment the first and second surfaces are each made up of a linear array of rectangular beams. For each of these surfaces, one face of each beam contributes to and is substantially coplanar with one face of each of the other beams in the array. Thus in this figure the first surface [1] comprises the coplanar set of faces of beams [1*a*,] [1*b*,] [1*c*,] etc. in the first array of beams, and the second surface [2] comprises the coplanar set of faces of beams [2*a*,] [2*b*,] [2*c*,] etc. in the second array of beams. The beams in an array may be clamped together by threaded rods which pass through aligned apertures in the beams with washers and nuts clamping the array at each end. Alternatively, an array of beams may be strapped together or built up with adhesive. The beams of the first and second arrays are rabbeted at their upper ends so as to interdigitate and conjoin to form an apex. It is also possible and within the scope of the invention to build up a first or second surface by combining other kinds of rabbeted beams such as round logs or timbers.

A lifting affordance [6] in this sort of embodiment may be fashioned from a plate having a lifting eye and sandwiched between any two individual beams in the conjoined arrays. For arrays end clamped by threaded rods, the lifting eye plate may include a second aperture through which a threaded rod passing through apices of the conjoined beams so that lifting force may be efficiently propagated throughout the conjoined arrays.

Trapezoidal plates [3L] affixed at the ends of the beam arrays maintain the splay angle similar to the side view seen in FIG. 3*c*. A first aperture [4*b*] in the first surface may be created by building up the first surface with long beams at the beginning and end of the array, and shorter beams in the middle of the array. Clamp rods or straps would extend from lateral edges at the bottom of the beam array to medial edges defining the sides of the aperture in the surface. The second surface in this figure also includes a first aperture [4*c*] built of shorter medial beams in its array. These apertures both open toward the ground, and are alignable along a work direction [P] so that the enclosure may be delivered and lowered in place over a joint site or work site along a lenticular object such as a pipeline being constructed.

Figure 9B:
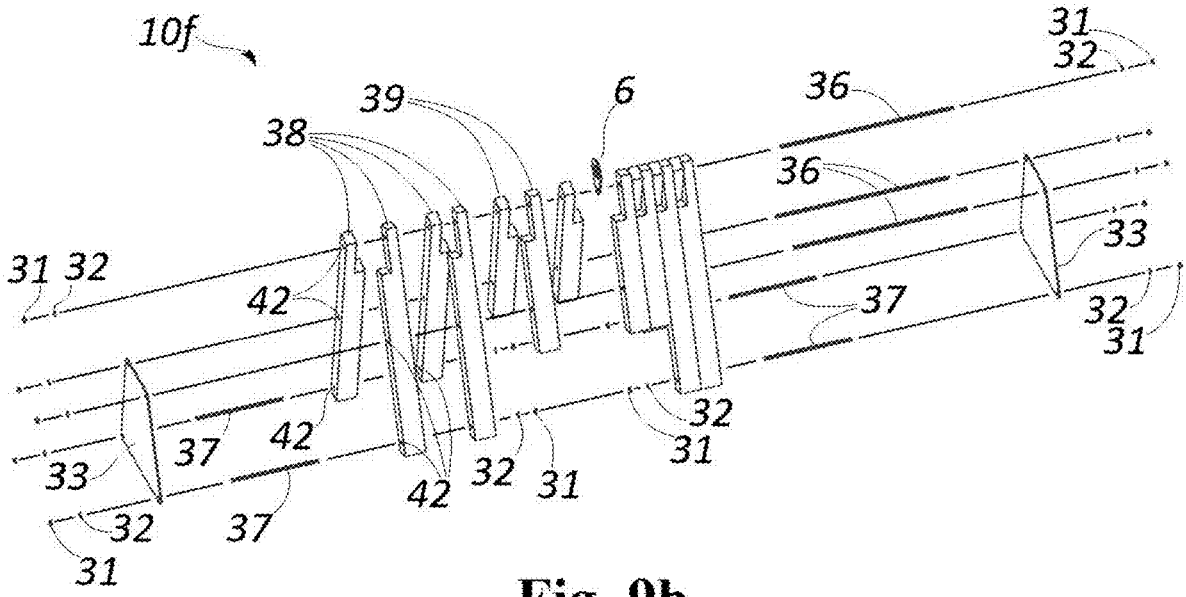
FIG. 9*b* shows an oblique, front top right view of the worksite enclosure of FIG. 9*a* with the lateral membranes and some of the railroad ties exploded for further inspection.

FIG. 9*b* shows an oblique, front top right view of the worksite enclosure or backfill accumulator [10*f*] of FIG. 9*a* with some of exemplary beam clamping hardware and the rabbeted beams that comprise the front and rear surfaces shown exploded in lateral directions. The enclosure is assembled with a first linear array of beams aligned so that the first surface is built up of a plurality of coplanar beam faces of beams which have been aligned to produce a first or forward facing surface. A second linear array of beams are similarly aligned to produce a second or rearward facing surface also built up of coplanar beam faces. The beams of the first and second linear array have rabbeted ends so that the rabbeted ends of the first linear array interdigitate with the rabbeted ends of the second linear array. Note also that beams such as railroad ties may have faces which are other than rectangular planes, and that a "surface" in this specification may not necessarily need to be planar. For example, a surface within the scope of the invention may also be built up of a lateral array of boughs lashed or otherwise clamped together, or may be built up from pallets.

The beams in an array may be clamped together by threaded rods [36] which pass through aligned apertures [42] in the beams with washers [32] and nuts [31] clamping the array at each end. The beams of the first and second arrays are rabbeted at their upper ends so as to interdigitate and conjoin to form an apex. Trapezoidal plates [33] affixed at the ends of the beam arrays maintain the splay angle similar to the side view seen in FIG. 3*c*. A first aperture in the first surface and a first aperture in the second surface may be created by building up the first surface with long beams at the beginning and end of the array, and shorter beams in the middle of the array. Clamp rods [37] shorter than the rods which pass through the full width of the enclosure extend from lateral edges at the bottom of the beam array to medial edges defining the sides of the aperture in the surface.

The lifting affordance [6] in this example is a plate with a first aperture as a lifting eye and a second aperture through which a threaded rod passes while also passing through apices of the conjoined beams so that lifting force may be efficiently propagated throughout the conjoined arrays.

Figure 10:
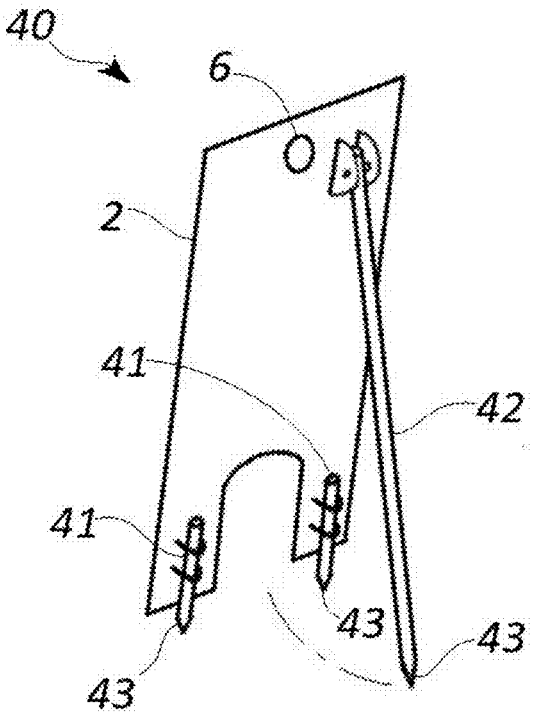
FIG. 10 shows an oblique, front top right view of an embodiment of a backfill accumulator in accordance with the invention for use in an improved open cut trenching method.

FIG. 10 shows an oblique, front top right view of an embodiment of a backfill accumulator [40] in accordance with the invention for use in an improved open cut trenching method. The first surface in this embodiment would pertain to a swing-out prop [42] which holds the second surface [2] at a steep angle against backfill material accumulating behind it. A lifting affordance [6] in this embodiment is a second aperture in the rearward facing surface which functions as a lifting eye. To resist forward directed force of accumulating backfill from displacing the rearward facing surface, one or more stakes or spikes [41] may be affixed by the bottom of the surface to act as ground engagement affordances [41.] Tapered or conical points at the lower tips of the prop and the stakes act as ground engagement incisors [43] which bite into the floor of the trench to resist displacement.

While certain features and aspects have been described with respect to exemplary embodiments, one skilled in the art will recognize that numerous modifications are possible.

Also, while certain functionality is ascribed to certain system components, unless the context dictates otherwise, this functionality may be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Furthermore, the procedures described with respect to one method or process may be incorporated within other described methods or processes; likewise, system components described according to a particular structural configuration and/or with respect to one system may be organized in alternative structural configurations and/or incorporated within other described systems.

The present disclosure is not to be limited in terms of the particular embodiments described in this application, which are intended as illustrations of various aspects. Many modifications and variations may be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Thus, unauthorized instances of apparatuses and methods claimed herein are to be considered infringing, no matter where in the world they are advertised, sold, offered for sale, used, possessed, or performed.

Consequently and in summary, although many exemplary embodiments are described above, it will be appreciated that the invention is intended to cover all modifications and equivalents within the scope of the following claims.

What is claimed is:

1. An enclosure comprising a first surface punctured by a first aperture, a second surface at least partially spaced apart from said first surface along a work direction and punctured by a first aperture, at least one lateral surface spanning between said first and second surfaces whereby said first and second surfaces and said at least one lateral surface define an enclosed volume, with at least a portion of said first surface not parallel to a portion of said second surface, a lifting affordance, said enclosure further comprising at least one tube mounted proximate to said lateral surface and piercing said first surface at an orifice where a lumen of said tube communicates outside said enclosed volume, said lumen of said tube is closable by a flap hingeably affixed to said first surface proximate said orifice, and an occluder affixed proximate to one of said first apertures.

2. The enclosure of claim 1, wherein a second aperture of said first surface comprises a flap hingeably affixed proximate thereto.

3. The enclosure of claim 2, further comprising a perforated shelf located between said first and second apertures of said first surface.

4. The enclosure of claim 1, wherein said tube is defined by a structural beam having an open contour closed by abutting said contour to any lateral surface.

5. The enclosure of claim 1, further comprising at least a first rectangular tube which pierces both said first and second surfaces of said enclosure.

6. The enclosure of claim 5, further comprising a second rectangular tube parallel to said first rectangular tube which also pierces both said first and second surfaces of said enclosure.

7. The enclosure of claim 1, further comprising at least one strake proximate a juncture of said first and second surfaces.

8. The enclosure of claim 1, further comprising a roof membrane spanning between said first and second surfaces, with said lifting affordance being affixed thereto.

9. The enclosure of claim 8, wherein said roof membrane comprises a shape selected from the set of shapes consisting of: a rectangle, a square, a triangle, a portion of a sphere, a dome, a portion of a cylinder, a portion of an ovoid, a parabolic arched vault, and a barrel vault.

10. The enclosure of claim 8, further comprising at least one strake affixed to said roof membrane.

11. The enclosure of claim 1, wherein said first surface comprises a perimeter interrupted by said first aperture.

12. The enclosure of claim 1, wherein said second surface comprises a perimeter interrupted by said first aperture.

13. The enclosure of claim 1, wherein said first aperture in said second surface is reinforced by reinforcing strips mounted proximate a perimeter of said first aperture of said second surface.

14. The enclosure of claim 1, further comprising an oblique floor plate proximate a bottom of said tube, said oblique floor plate being oriented skew from perpendicular to an axis of said tube.

15. The enclosure of claim 1, wherein said lifting affordance comprises a bar affixed to an upper aspect of said enclosure, said bar being formed to create an aperture for receiving lifting means.

16. The enclosure of claim 1, wherein said lifting affordance comprises a loop of lifting chain having ends affixed to an upper aspect of said enclosure.

* * * * *